United States Patent [19]

Janssen et al.

[11] Patent Number: 4,855,960

[45] Date of Patent: Aug. 8, 1989

[54] PROCESS AND APPARATUS FOR THE PREPARATION OF MORTARS

[76] Inventors: Wilhelmus G. E. Janssen; Herve J. W. Janssen, both of Ubroekweg 39-41, Venlo-Blerick, Netherlands

[21] Appl. No.: 124,402

[22] Filed: Nov. 20, 1987

Related U.S. Application Data

[63] Continuation of Ser. No. 725,327, Apr. 19, 1985, abandoned, which is a continuation-in-part of Ser. No. 489,242, Apr. 27, 1983, abandoned.

[30] Foreign Application Priority Data

Apr. 30, 1982 [BE] Belgium ..... 1/10502

[51] Int. Cl.[4] ..... B01F 7/08

[52] U.S. Cl. ..... 366/8; 366/19; 366/28; 366/33; 366/38

[58] Field of Search ..... 366/196, 291, 297

[56] References Cited

U.S. PATENT DOCUMENTS

| | | | |
|---|---|---|---|
| 858,017 | 6/1907 | Pence | 366/35 |
| 1,904,884 | 6/1929 | Royle | 366/144 |
| 2,031,326 | 2/1936 | Miller . | |
| 2,755,000 | 7/1956 | Parre | 222/146.5 |
| 2,828,112 | 3/1958 | O'Kammer | 366/144 |
| 2,837,242 | 6/1958 | McLaughlin | 222/146.5 |
| 3,048,377 | 8/1962 | Braitsch | 366/27 |
| 3,069,735 | 12/1962 | Toulmin, Jr. | 422/307 |
| 3,123,065 | 3/1964 | Conley | 219/312 X |
| 3,183,099 | 5/1965 | Schultz et al. | 366/148 |
| 3,207,365 | 9/1965 | Burford | 222/146.5 |
| 3,358,976 | 12/1967 | Siktberg . | |
| 3,415,498 | 10/1968 | Zaccaron | 366/37 |
| 3,451,659 | 6/1969 | Tobolov et al. | 366/27 |
| 3,575,157 | 4/1971 | Whittel, Jr. | 126/362 |
| 3,817,497 | 6/1974 | Waltman | 366/22 |
| 3,822,866 | 7/1974 | Daester et al. | 366/8 |
| 3,871,628 | 3/1975 | Pulk et al. | 366/35 |
| 3,891,193 | 6/1975 | Perry, Jr. . | |
| 3,998,436 | 12/1976 | Allen et al. | 366/18 |
| 4,049,244 | 9/1977 | Hedrich | 366/192 |
| 4,161,647 | 7/1979 | Carbonnel | 137/341 |
| 4,189,237 | 2/1980 | Bake | 366/2 |
| 4,298,288 | 11/1981 | Weisbrod | 366/27 |

FOREIGN PATENT DOCUMENTS

| | | |
|---|---|---|
| 110869 | 6/1940 | Australia . |
| 412147 | 11/1966 | Australia . |
| 893035 | 11/1982 | Belgium . |
| 94509 | 3/1963 | Denmark . |
| 8110879 | 10/1981 | European Pat. Off. . |
| 801560 | 7/1949 | Fed. Rep. of Germany . |
| 1455635 | 6/1969 | Fed. Rep. of Germany . |
| 2808777 | 9/1970 | Fed. Rep. of Germany . |
| 2057064 | 6/1972 | Fed. Rep. of Germany . |
| 2148048 | 3/1973 | Fed. Rep. of Germany . |
| 2323259 | 11/1974 | Fed. Rep. of Germany . |
| 2729597 | 1/1978 | Fed. Rep. of Germany . |
| 3004890 | 3/1979 | Fed. Rep. of Germany . |
| 55136 | 11/1973 | Finland . |
| 2194151 | 2/1974 | France . |
| 2357400 | 2/1978 | France . |
| 7502134 | 2/1975 | Netherlands . |
| 7607466 | 7/1976 | Netherlands . |
| 7707747 | 12/1977 | Netherlands . |
| 358583 | 8/1973 | Sweden . |
| 1017225 | 1/1966 | United Kingdom . |
| 1417049 | 12/1975 | United Kingdom . |

*Primary Examiner*—Frankie L. Stinson

*Attorney, Agent, or Firm*—Majestic, Parsons, Siebert & Hsue

[57] ABSTRACT

A process and apparatus for the preparation of mortar from an aggregate and a binder is disclosed which comprises the use of a silo provided with at least one partition so as to create in the silo two or more compartments for the separate storage of the aggregate and the binder, the compartments being provided with conveyor screws, the speeds of which can be adjusted to control the volumetric flow of the components to a mixing chamber. When the desired amounts have been dispensed, the remaining materials may be stored indefinitely for layer use. The silo compartment for the aggregate may be provided with a heating element to safeguard the mechanically operated slide valve against freezing. The conveyor screw in the outlet for the binder may be provided with a cam and a plunger rod with transverse projections to prevent arching in the compartment for the storage of the binder.

The apparatus may be removably mounted on a truck so that it may be loaded and unloaded easily for transport to and storage at the building site.

16 Claims, 4 Drawing Sheets

PROCESS AND APPARATUS FOR THE PREPARATION OF MORTARS

CROSS REFERENCE TO RELATED APPLICATIONS

This application is a continuation application of application Ser. No. 06/725,327 entitled "Process and Apparatus for the Preparation of Mortars" filed Apr. 19, 1985 by Wilhelmus G. E. Janssen and Herve J. W. Janssen and now abandoned, where Ser. No. 06/725,327 is in turn a continuation-in-part application of parent application Ser. No. 06/489,242, of the same title, filed Apr. 27, 1983 and now abandoned by the same inventors. The parent application claimed the right of priority under 35 U.S.C. 119 based upon Belgian application No. PV1/10502, filed Apr. 30, 1982, now Belgian Patent No. 893035.

BACKGROUND OF THE INVENTION

The invention relates to a process and apparatus for the preparation of mortar, such as jointing mortar.

It is known that ready-made mortars can be prepared in a mortar plant where the aggregate, binding agents and water are weighed out for a definite batch and then conducted to a mixing chamber. The product is referred to as wet mortar to which a retarder can be added in order to keep the mortar workable for a longer period. The wet mortar is conveyed to the building site by trucks having rotating (mixing) drums mounted on them.

A system for manufacturing ready-made mortars in a mortar plant is disclosed by Tobolov et al, U.S. Pat. No. 3,451,659. Tobolov et al disclose a plant for mixing sand with a hardener in which the rate of sand feed is controlled by a conveyor belt and the rate of hardener feed is controlled by a screw feeder. After being mixed, a liquid is then added to the mixture. Thus the rates of sand and hardener feed rates are controlled to achieve the desired proportions of each in the mixture. Apparently, Tobolov et al's finished product is wet mortar which must still be conveyed to building sites by trucks equipped with rotating (mixing) drums.

It is also known that dried and premixed mortars can be prepared in a special drying and mixing plant, whereupon the dry mortars are transported to the building site by bulk lorry. At the building site the dry mortar is dumped into a storage bunker positioned over a mixing device for mixing the dry mortar with water so as to obtain a workable mortar.

The known processes and apparatus have the following drawbacks:

The aggregate must be predried in order to obviate partial hardening with the previously mixed binding agent, a rather costly step in view of the expenditure of energy.

As the aggregate is not completely dry in actual practice, the dry mortar has only limited keeping qualities.

The completely weighed-out batch from the storage bunkers must invariably be mixed with water, which leads to waste of mortar not needed for immediate use.

It is further known to use separate containers for containing the binder and aggregate separately. These containers are then mounted onto trucks and transported to building sites where the binder and aggregate are mixed and used. Such systems are disclosed, for example, in U.S. Pat. Nos. 3,048,377 to Braitsch and 4,189,237 to Bake. Since trucks making deliveries of binder and aggregate may be delivering to more than one building site, and since the requirement at each building site may differ, it is desirable for the containers on the trucks to be capable of dispensing different quantities of binder and aggregate at each site. While Bake did disclose that the entire stock of binder and aggregate on the truck might be stored in a number of containers so that only some of the containers would be emptied at each site, the entire contents of one or more containers must be dispensed at a time. Thus if the actual amount of materials desired on site turned out to be different from those contained in any one of the containers, the excess amounts dispensed would be wasted.

For many construction tasks, it is desirable to have an inexpensive supply of moderate but variable amounts of high quality mortar continually over an extended time period. For such tasks, none of the above described systems appear to be entirely satisfactory. It is therefore desirable to provide an economical and flexible system which is capable of fulfilling such needs.

SUMMARY OF THE INVENTION

The object of the present invention is to provide an improved process and apparatus of the type described herein before. To this end, the process is designed such that a silo mounted on an undercarriage and located on a storage yard or in a storage space for aggregate and binding agents is filled in such a fashion that the aggregate and the binder are contained in separate compartments within one silo. The silo and the undercarriage are then loaded onto a truck and conveyed to the building site where the volumetric flows of aggregate and binder are mutually adjusted, whereupon the desired amounts of aggregate and the binder are dispensed and mixed together with addition of water, yielding the mortar ready for use at the building site. The silo together with the undercarriage may be conveniently loaded and unloaded onto trucks so that, if so desired, the silo may be unloaded to remain on a building site for supplying fresh-mixed high quality mortar thereby freeing the truck. The silo can then supply mortar over any time period and in only such quantities as are needed to reduce waste.

The new process with associated apparatus has the following advantages:

Only the desired amounts of binder and aggregate need to be dispensed so that little materials are wasted; the remaining materials may be stored indefinitely in the compartments for later use. If so desired, the silo together with the undercarriage may be removed from the truck and retained on the building site so that widely different amounts of materials may be dispensed continually over a long time period without requiring the truck, usually an expensive piece of equipment, to be immobilized at a particular building site over the time period. This results in a highly economical and flexible system. Related and further advantages are as follows:

At the building site the quantities of mortar needed for immediate use can at all times be mixed.

The volumetric flows can be mutually adjusted by very simple means, and the set value can be maintained effectively.

The aggregate need not be predried.

The composition of the mix is not attained by weighing, which obviates the use of fairly expensive weighing equipment.

There is no need for dosing auxiliary substances such as retard and air-entraining agents, hence no risk of adding too large doses of retarder and air-entraining agents.

For application of the new process, it is preferred to use a silo which is provided at the bottom with a funnel-shaped section and which has been mounted on an undercarriage, the said silo according to the invention having at least one partition for the separate storage of the aggregate and the binder in individual compartments, each of which has one outlet, of which the outlet for the aggregate is provided with a conveyor screw, whilst the outlet for the binding agent has another conveyor screw, in such a way that the two conveyor screws discharge into a mixing chamber and that the speeds of the conveyor screws for the binder and for the aggregate are adjustable relative to one another.

The said mixing chamber may be provided with a metering valve for water discharging into it. Furthermore, the silo may be designed such that it can, with fittings and accessories, be loaded on a truck and conveyed as a container.

The advantage of this design are that it permits a compact storage with a volumetric adjustment of the amounts of aggregate and binder;

a simple metering of water;

efficient transport of the silo to the building site with the special container trucks.

In addition, the outlet for the aggregate may be provided with a mechanically operated slide, safeguarded against freezing fast by heating, with a further heating element mounted high up in the silo compartment for the aggregate, so that in the event of slight night frost jamming of the slide and clogging together of the aggregate can quickly be undone through heating.

Moreover, in order to prevent any arching in the binder, the shaft of the conveyor screw for the binder has been provided with a cam against which a plunger rod rests; this rod terminates in the binder compartment and carries transverse projections.

DETAILED DESCRIPTION OF THE PREFERRED EMBODIMENT

To elucidate the invention, an embodiment will be described by way of example, with reference to the attached drawings, where:

Figure 3:
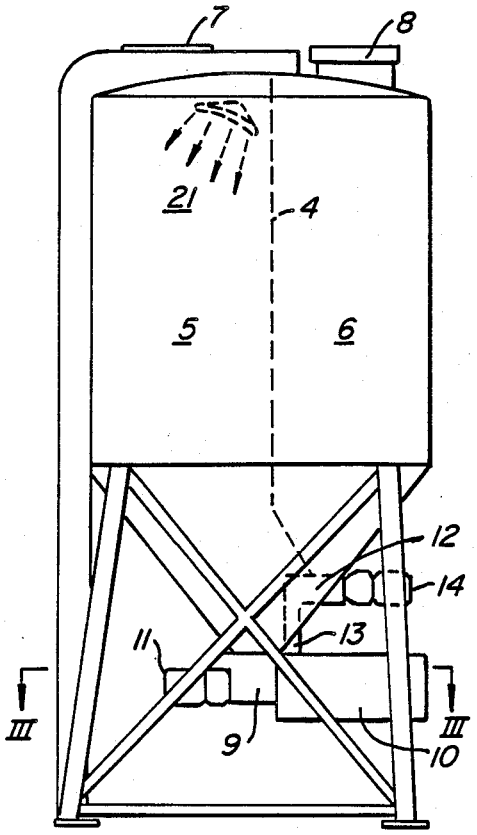
FIG. 3 shows a lateral view of the silo.
Figure 4:
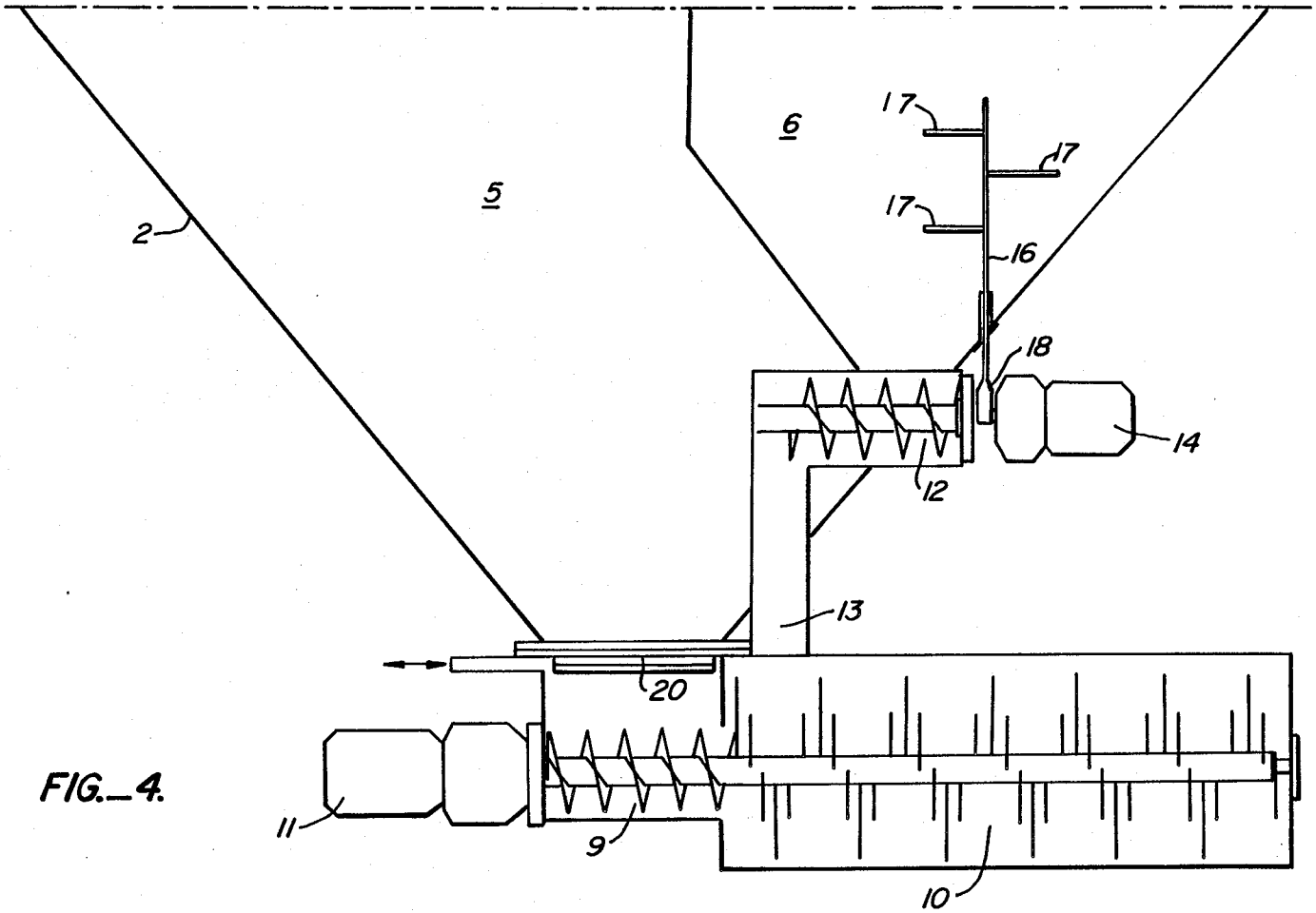
Figure 5:
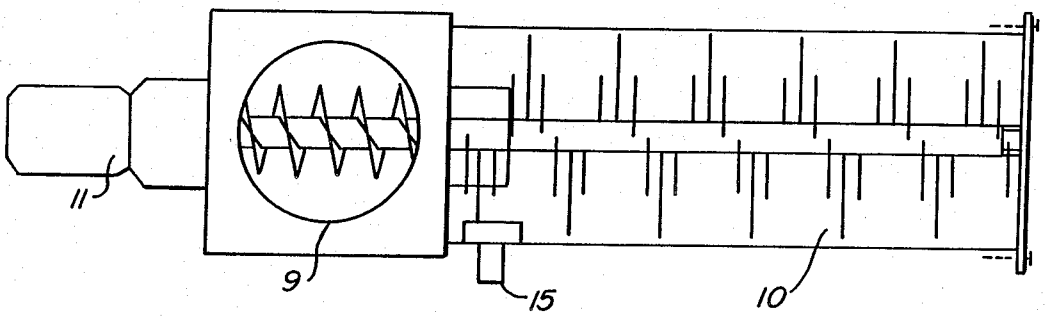
Figure 6:
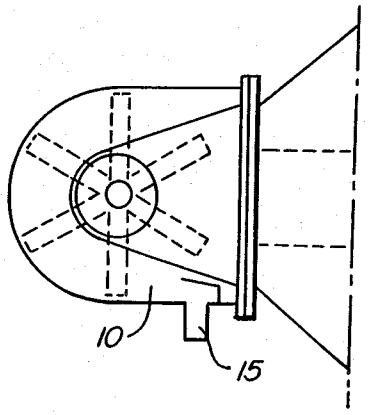

FIG. 4 presents a detailed view of two conveyor screws and a mixing chamber, drawn to a larger scale that in FIG. 3;

FIG. 5 presents a detailed top view, also drawn to a larger scale, of the conveyor screw for the aggregate and the mixing chamber following the section at III—III in FIG. 3; and FIG. 6 is a lateral view of the mixing chamber.

Figure 1:
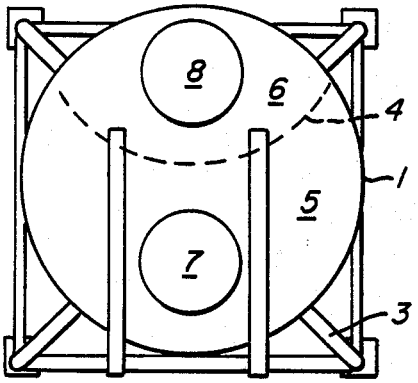
FIG. 1 shows a top view of a silo.

FIGS. 7–10 are schematic views of a silo, an undercarriage and a truck illustrating the loading and unloading of the silo of FIG. 1 onto the truck.

The apparatus comprises a silo 1 with a funnel-shaped section 2 which is provided with an undercarriage 3. The silo is divided by means of a partition 4 into the compartments 5 and 6. Compartment 5 has a filling hole 7 for the aggregate and compartment 6 a filling hole 8 for the binder. At the bottom of the funnel-shaped section 2 there is a conveyor screw 9 with a mixing chamber 10, the said conveyor screw 9 being driven by an electric motor 11 at a constant speed of rotation. At the bottom of compartment 6 a second conveyor screw 12 is mounted which communicates through a transfer line 13 with the mixing chamber 10. The conveyor screw 12 is driven by an electric motor 14 with infinitely variable speed regulator. The mixing chamber 10 is provided with a branch 15 which has a metering valve for the supply of water.

Mortar of the desired composition is prepared in the following way. From compartment 5, aggregate passes onto the conveyor screw 9 which transports the aggregate at a constant speed to the mixing chamber 10. At the same time, the binder is led from compartment 6 to the second conveyor screw 12 which transports the binder also to the mixing chamber 10 through line 13. The conveying speed of the conveyor screw 12 can be selected at will with the aid of the infinitely variable speed regulator of the electric motor 14. The magnitude of the adjusted speed at which the second conveyor screw 12 is driven should be determined experimentally in such a fashion that the desired mixing ratio of aggregate to binder for the jointing or concrete mortar is obtained. The speed of the conveyor screw 9 and the mixer in mixing chamber 10, however, remains constant at all times. When the desired amounts of binder and aggregate have been dispensed, the conveyor screws 9, 12 and their corresponding motors 11, 14 are stopped so that the remaining portions of undispensed aggregate and binder in the compartments 5, 6 may be retained indefinitely for later use.

Mortar can be prepared in the way outlined above by a continuous process. Dosing of the aggregate and the binder can be effected without valves. In consequence, the two conveyor screws 9 and 12 fulfill the dual function of dosing and conveying.

The outlet at the bottom of the aggregate compartment can be closed with a slide 20 in order to permit the mixing chamber to be emptied. After slide 20 has been closed and the supply of binder stopped, the mixing chamber 10 is emptied and flushed clean with water.

To permit operation of slide 20 in frosty weather, an electric heating cable has been mounted near the supporting edge of the slide. In addition, a heating element 21 is provided high up in the aggregate compartment so as to eliminate or prevent any clogging together of the aggregate.

Arching in the binder compartment is obviated by the provision of a plunger rod 16 with transverse projections 17 moving up and down in the said compartment. Up and down movement of the rod 16 is brought about by means of cam 18.

Figure 2:
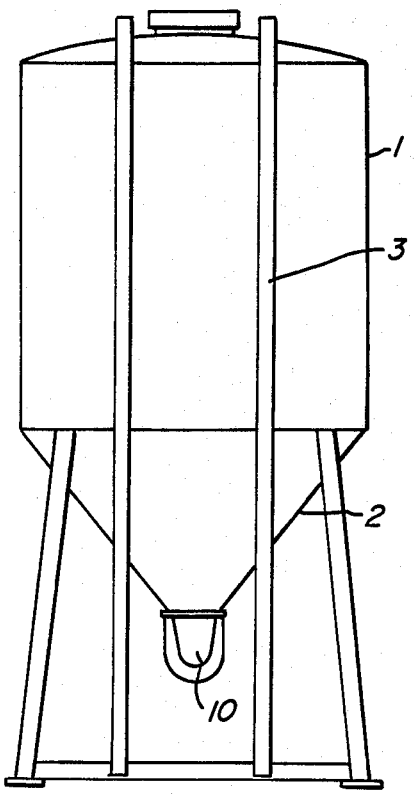
FIG. 2 shows a front view of the silo.
Figure 7:
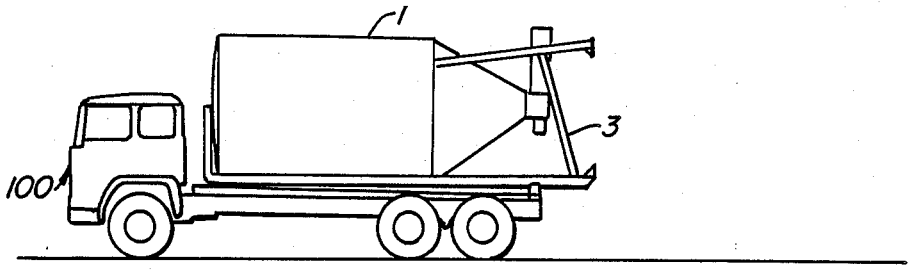
Figure 8:
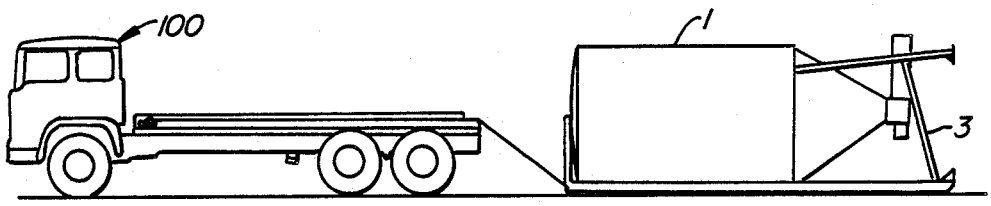
Figure 9:
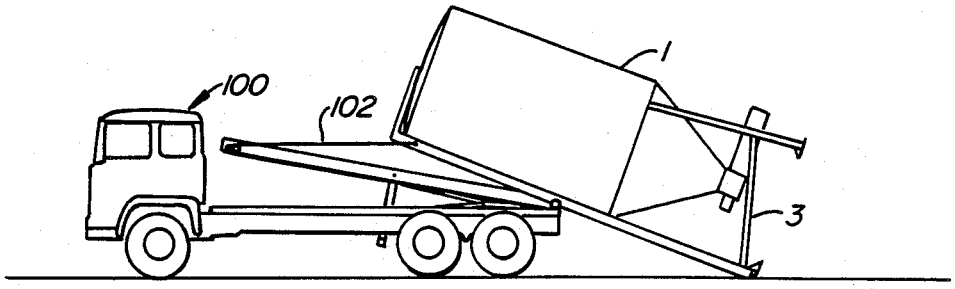
Figure 10:
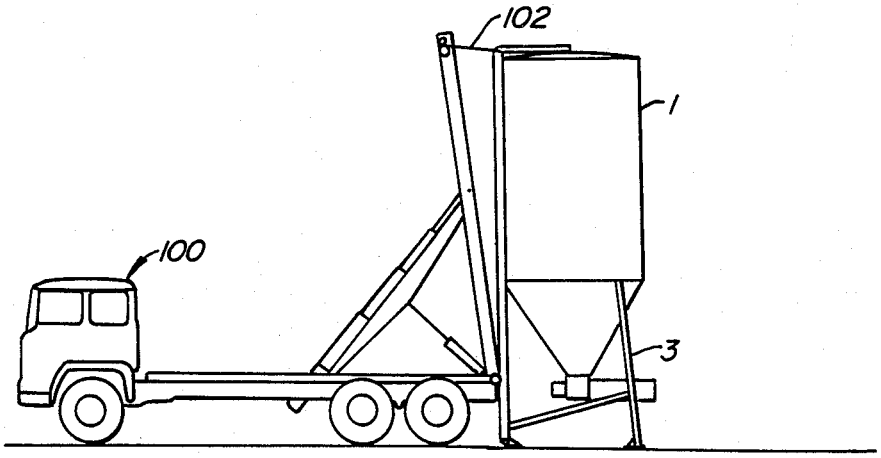

As shown in FIGS. 7–10, the silo 1 and the undercarriage 3 may be easily loaded and unloaded from a truck 100. To simplify the figures, only part of the undercarriage 3 of FIGS. 1 and 2 is shown in FIGS. 7–10. Silo 1 already mounted on undercarriage 3 is transported by truck 100 as shown in FIG. 7. When it is desired to unload the silo, the silo together with the undercarriage are tilted as shown in FIG. 9 until they slide down with the undercarriage 3 touching the ground. A cable 102 connecting the top of the undercarriage 3 to the truck enables the sliding motion to be smooth and prevents any sudden falls. Then the silo may be allowed to rest on its side as shown in FIG. 8 or further tilted to its upright position as shown in FIG. 10. To load the silo and the undercarriage onto the truck 100, the process just described is simply reversed, again with the help of cable 102.

We claim:

1. A process for the preparation of brick-laying or jointing mortar from an aggregate and a binder using a device which includes a silo, a frame on which the silo is mounted and mixing accessories connected to the frame or silo, so that the mortar is ready for use on a building site, by jointing a desired amount of mortar of a desired proportion of aggregate to binder, to yield small quantities of mortar such as in batches of ⅓ cubic feet or less, which comprises the steps of:

filling the silo located on a storage yard or in a storage space in such a way, that the aggregate and the binder are contained in separate compartments within the silo, said compartments having outlets for the dispensation of the aggregate and the binder;

loading the filled silo, frame and mixing accessories onto a vehicle;

transporting the silo, frame and mixing accessories with the aggregate and the binder by means of a vehicle to a building site with the silo in a substantially horizontal position and so that the frame, mixing accessories, the silo and the aggregate and binder in the silo are fully supported by the vehicle;

unloading said silo, mixing accessories and frame from the vehicle at the building site by tilting the frame and silo to a substantially vertical operational position, so that said silo, mixing accessories and frame may be left at the site for preparation and dispensation of desired amounts of mortar from time to time when desired, wherein the silo, mixing accessories and frame are completely free from the vehicle;

adjusting relative volumetric flows of aggregate and binder to obtain the desired proportion and stopping said flows when batches of desired amounts of aggregate and binder have been dispensed so that the remaining aggregate and binder are stored in said separate compartments of the silo for later use; and mixing the aggregate and the binder while adding the required proportion of water.

2. A portable device for the preparation of mortar comprising:

an elongated silo for carrying an aggregate and a binder having top and bottom opposite ends, said silo adapted for transportation by a vehicle having a bed in a substantially horizontal position with said top and bottom ends at substantially equal height and for the dispensation of mortar in a substantially vertical position with said top end positioned above said bottom end, said silo having hollow body portion open at said opposite top and bottom ends and having top and bottom closure members at the respective ends for closing off said open ends and retaining the aggregate and binder in the silo when the silo is in a horizontal position;

partition means within said body for dividing the silo into two individual side by side compartments for the storage of aggregate and binder, said compartments each defining an outlet in said bottom end closure member;

said silo adapted for dispensing aggregate and binder through the outlets at the bottom end when the silo is in the vertical position;

conveyor screw means adjacent said outlets for discharging aggregate and binder;

means for controlling said conveyor screw means, including its speed, so that desired amounts of aggregate and binder are discharged by the conveyor screw means in a predetermined proportion, so that the remaining aggregate and binder are stored in their respective compartments for later use;

a mixing chamber for receiving the aggregate and binder discharged by the conveyor screw means from the compartments, said conveyor screw means, controlling means and the mixing chamber being adjacent to said bottom end; and frame means having a plurality of leg means adjacent said bottom end and extending therefrom for supporting the silo on a support surface in the vertical position during dispensation of mortar where said bottom end is positioned above and spaced from the support surface, said frame means connected to the silo to facilitate the tilting of the silo between the horizontal and vertical positions and the loading and unloading of the silo from the bed of the vehicle, said frame means forming an integral part of the device adapted to be transported by and unloaded from the bed of the vehicle and set up at a building site for the preparation of mortar, wherein the frame means comprises bars rigidly connected together to form a rigid structure and wherein the mixing chamber, the conveyor screw means, said controlling means and mixing chamber are all spatially enclosed by the frame means to facilitate transportation and setting up of the device.

3. A device as claimed in claim 2, additionally comprising a valve for metering water into the said mixing chamber.

4. A device as claimed in claim 2, in which the bottom closure member is a mechanically operated slide provided with heating means as a safeguard against freezing fast.

5. A device as claimed in claim 2, further comprising a heating means mounted in the upper part of said storage compartment for the aggregate.

6. A device as claimed in claim 2 wherein said conveyor screw means includes a shaft and a cam carried by the shaft, said device further comprising a plunger rod terminating in the storage compartment for the binder and being provided with transverse projections, said plunger rod resting against the cam so that the cam will cause the plunger rod to move up and down in the storage compartment for the binder when the shaft rotates.

7. A device as claimed in claim 6 further comprising fittings and accessories for assisting the mounting of the silo and frame on the truck.

8. A device as claimed in claim 2 further comprising fittings and accessories for assisting the mounting of the silo and frame on the truck.

9. The device of claim 2, further comprising unloading means which unloads the silo and said frame means at the building site by tilting the silo and frame means to an upright position for preparation and dispensation of mortar.

10. The device of claim 9, wherein said unloading means includes a cable for assisting the tilting of the silo and frame.

11. The device of claim 2, wherein the conveyor screw means has an axle, said apparatus further comprising means in the mixing chamber for mixing the aggregate and binder, said axle of the conveyor screw means also serving as an axle for the mixing means, so that the rotation of the axle of the conveyor screw means also causes the mixing means to mix the aggregate and the binder.

12. The device of claim 2, wherein the mixing chamber is attached to the silo at its bottom end so that the mixing chamber is immediately below the open end of the silo at the bottom end when the silo is in the vertical position.

13. The device of claim 2, wherein the conveyor screw means includes a conveyor screw at said outlet of the compartment for binder and a second conveyor screw at said outlet of the compartment for aggregate, and wherein one of the two conveyor screws has an axle, said device further comprising mixing means in the mixing chamber for mixing the aggregate and binder, said axle of said one conveyor screw also serving as an axle for the mixing means, so that the rotation of the axle of said one conveyor screw also causes the mixing means to mix the aggregate and the binder.

14. A method for the preparation of mortar by means of a portable device including (a) an elongated hollow silo for carrying an aggregate and a binder defining a hollow body portion open at the top and bottom opposite ends having top and bottom closure members closing off the respective ends, said silo adapted for transportation by a vehicle in a substantially horizontal position with said top and bottom ends at substantially equal height and for the dispensation of mortar in a substantially vertical position with said top end positioned above said bottom end, said closure members at the two ends serving to retain the aggregate and binder in the silo when the silo is in a horizontal position; partition means within said body for dividing the silo into two side by side individual compartments for the storage of aggregate and binder, said compartments each defining an outlet at the bottom end; said silo adapted for dispensing aggregate and binder through the outlets at the bottom end when the silo is in the vertical position; (b) conveyor screw means at the outlets for discharging aggregate and binder; (c) means for controlling the conveyor screw means, including its speed, so that desired amounts of aggregate and binder are discharged by the conveyor screw means in a predetermined proportion, so that the remaining aggregate and binder are stored in their respective compartments for later use; and (d) a mixing chamber for receiving the aggregate and binder discharged by the conveyor screw means from the compartments, said method comprising:

filling the two compartments from the top end with aggregate and binder with the silo in the vertical position;

tilting the silo from the vertical position to a horizontal position and loading the silo onto the bed of a vehicle;

transporting the silo in the horizontal position to a building site;

unloading the silo from the vehicle and tilting the silo into the vertical position;

adjusting the conveyor screw means to adjust the relative volumetric flows of aggregate and binder to obtain the desired proportion;

discharging the aggregate and binder from the bottom end in the predetermined proportion into the mixing chamber and stopping said flows when desired amounts of aggregate and binder have been dispensed so that the remaining aggregate and binder are stored in separate compartments of the silo for later use; and mixing the aggregate and the binder while adding the required proportion of water.

15. The method of claim 14, said device further comprising frame means having leg means for supporting the silo in the vertical position during dispensation of mortar, said frame means connected to the silo, said frame means forming an integral part of the device adapted to be transported by and unloaded from the bed of a vehicle and set up at a building site for the preparation of mortar, wherein the loading, tilting and unloading steps are accomplished by applying force to the frame means thereby reducing wear on the silo, and wherein the step of tilting the silo into the vertical position tilts the frame means until the silo is entirely supported by the leg means.

16. The method of claim 15, wherein the conveyor screw means includes a conveyor screw at the outlet means of the compartment for binder and a second conveyor screw at the outlet means of the compartment for aggregate, and wherein one of the two conveyor screws has an axle, said device further comprising means in the mixing chamber for mixing the aggregate and binder, said axle of said one conveyor screw also serving as an axle for the mixing means, so that the rotation of the axle of said one conveyor screw also causes the mixing means to mix the aggregate and the binder, wherein the steps of discharging the aggregate and binder and mixing the aggregate and binder are accomplished by turning the two conveyor screws.

* * * * *